US005412852A

United States Patent [19]

Smaragdas

[11] Patent Number: 5,412,852

[45] Date of Patent: May 9, 1995

[54] FASTENING CONVERSION SYSTEM FOR A SHOE

[76] Inventor: Arthur J. Smaragdas, 111 Lakeside Dr., Rockville Center, N.Y. 11570

[21] Appl. No.: 115,583

[22] Filed: Sep. 3, 1993

[51] Int. Cl.[6] ..... A43B 11/00

[52] U.S. Cl. ..... 24/713.6; 24/712; 24/712.1; 36/50.1

[58] Field of Search ..... 24/713.6, 713.8, 714.6, 24/715.1, 712, 712.1, 712.2, 714.5, 713.7, 715.7, 715.3, 306; 36/50.1, 51

[56] References Cited

U.S. PATENT DOCUMENTS

| | | | |
|---|---|---|---|
| 1,635,884 | 7/1927 | Gilewicz | 24/712 |
| 1,890,368 | 12/1932 | Chesler | 24/713.7 |
| 3,363,288 | 1/1968 | Lange et al. | 36/50.1 |
| 4,733,439 | 3/1988 | Gentry | 36/50.1 |
| 4,790,048 | 12/1988 | Arnt | 36/50.1 |
| 4,907,352 | 3/1990 | Ginsberg | 24/306 |
| 4,991,273 | 2/1991 | Huttle | 24/712.1 |
| 5,027,482 | 7/1991 | Torppey | 24/712 |
| 5,074,059 | 12/1991 | Melcher | 36/50.1 |
| 5,230,171 | 7/1993 | Cardaropoli | 36/50.1 |
| 5,295,315 | 3/1994 | Osawa et al. | 36/50.1 |

FOREIGN PATENT DOCUMENTS

| | | | |
|---|---|---|---|
| 0062954 | 1/1914 | Austria | 24/713.6 |

*Primary Examiner*—Victor N. Sakran

[57] ABSTRACT

A fastening conversion system is provided for a shoe having a throat with a set of spaced apart eyelets on each side of the throat, which consists of a closure member. A device is for securing the closure member to the first set of the spaced apart eyelets. A first portion of a releasing retainer is affixed to the closure member. A second portion of the releasing retainer is also provided. An apparatus is for securing the second portion of the releasing retainer to the second set of the spaced apart eyelets. When the closure member is placed in a closed position over the throat of the shoe, the first portion of the releasing retainer will engage with the second portion of the releasing retainer, to help keep the shoe on a foot of a person wearing the shoe.

15 Claims, 3 Drawing Sheets

FASTENING CONVERSION SYSTEM FOR A SHOE

BACKGROUND OF THE INVENTION

1. Field of the Invention

The instant invention relates generally to lacing apparatuses and more specifically it relates to fastening conversion system for a shoe.

2. Description of the Prior Art

Numerous lacing apparatuses have been provided in prior art that are strings, cords, braids or leather strips used for fastening shoes. While these units may be suitable for the particular purpose to which they address, they would not be as suitable for the purposes of the present invention as heretofore described.

SUMMARY OF THE INVENTION

A primary object of the present invention is to provide a fastening conversion system for a shoe that will overcome the shortcomings of the prior art devices.

Another object is to provide a fastening conversion system for a shoe that is designed to replace a conventional shoelace on the shoe with a much more convenient type of closure.

An additional object is to provide a fastening conversion system for a shoe that can be secured in a matter of seconds without the need to maintain an awkwardly bent posture, while fumbling with cumbersome laces and is especially valuable to people with arthritic fingers, children, the elderly and the handicapped.

A further object is to provide a fastening conversion system for a shoe that is simple and easy to use.

A still further object is to provide a fastening conversion system for a shoe that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
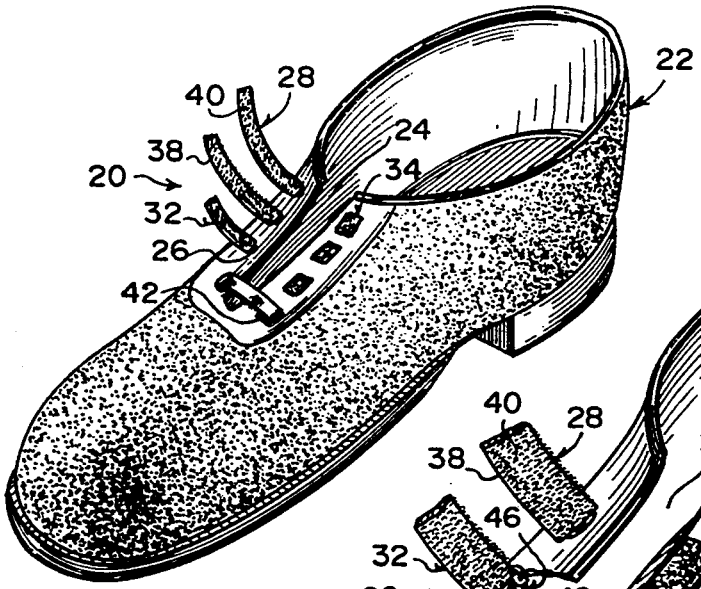
FIG. 1 is a perspective view of a shoe showing a first embodiment of the instant invention attached thereto.
Figure 2:
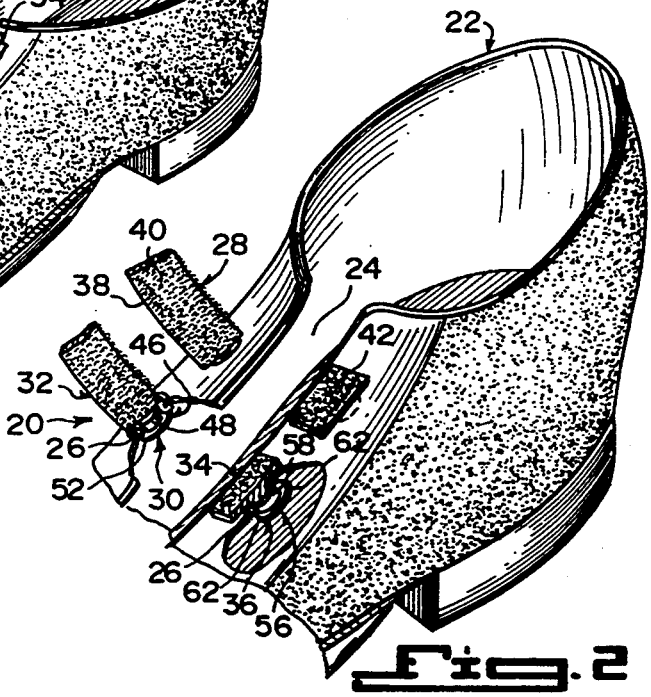
FIG. 2 is an enlarged perspective view of the shoe with parts broken away, showing the first embodiment in greater detail.

Turning now descriptively to the drawings, in which similar reference characters denote similar elements throughout the several views, FIGS. 1 through 6 illustrate a fastening conversion system 20 for a shoe 22, having a throat 24 with a set of spaced apart eyelets 26 on each side of the throat 24, which consists of a closure member 28. A device 30 is for securing the closure member 28 to the first set of the spaced apart eyelets 26. A first portion 32 of a releasing retainer is affixed to the closure member 28. A second portion of the releasing retainer is also provided. An apparatus 36 is for securing the second portion 34 of the releasing retainer to the second set of the spaced apart eyelets 26. When the closure member 28 is placed in a closed position over the throat 24 of the shoe 22, the first portion 32 of the releasing retainer will engage with the second portion 34 of the releasing retainer, to help keep the shoe 22 on a foot of a person wearing the shoe 22.

As shown in FIGS. 1 through 6, 10, 11, and 14 through 16, the closure member 28 is a plurality of straps 38. The first portion 32 of the releasing retainer, as shown in FIGS. 1 through 5, is a plurality of hooked VELCRO strips 40, each affixed to an underside of each strap 38. The second portion 34 of the releasing retainer, as shown in FIGS. 1 through 4, is a plurality of looped VELCRO pads 42, in which each will engage with one hooked VELCRO strip 40.

Figure 3:
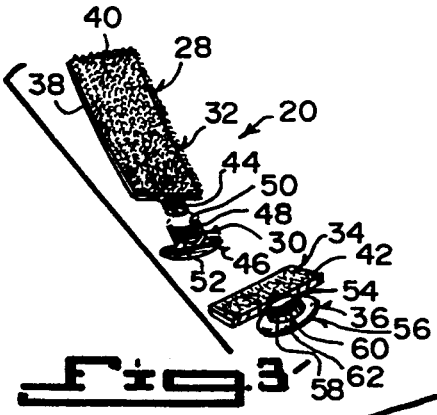
FIG. 3 is a perspective view of the first embodiment per se with parts broken away.

The closure member securing device 30, as best shown in FIG. 3, includes a plurality of externally threaded shanks 44, each affixed to an end of each strap 38.

A plurality of caps 46 are provided, with each having a barrel 48 with an internally threaded bore 50 and a flange 52 at the closed end of the barrel 48. Each barrel 48 can be inserted into each eyelet 26 of the first set in the shoe 22, with the flange 52 underneath the eyelet 26. Each shank 44 can be screwed into each barrel 48, to be removably attached thereto.

As best shown in FIG. 3, the securing apparatus 36 contains a plurality of externally threaded shanks 54, each affixed to an underside of each looped VELCRO pad 42. A plurality of caps 56 are provided, with each having a barrel 58 with an internally threaded bore 60 and a flange 62 at the closed end of the barrel 58. Each barrel 58 can be inserted into each eyelet 26 of the second set in the shoe 22, with the flange 62 underneath the eyelet 26. Each shank 54 can be screwed into each barrel 58 to be removably attached thereto.

Figure 4:
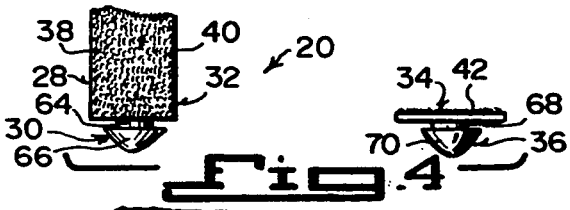
FIG. 4 is an electrical view with parts broken away of a second embodiment of the instant invention.

In FIG. 4, the closure member securing device 30 consists of a plurality of shanks 64, in which one is shown affixed to an end of one strap 38. A plurality of flexible dome shaped anchor heads 66 are provided, in which one is shown affixed onto an end of the shank 64. Each anchor head 66 can be inserted into each eyelet 26 of the first set in the shoe 22, to be permanently attached thereto.

In FIG. 4, the securing apparatus 36 includes a plurality of shanks 68, in which one is shown affixed to an underside of one looped VELCRO pad 42. A plurality of flexible dome shaped anchor heads 70 are provided, in which one is shown affixed onto an end of the shank 68. Each anchor head 70 can be inserted into each eyelet 26 of the first set in the shoe 22, to be permanently attached thereto.

Figure 5:
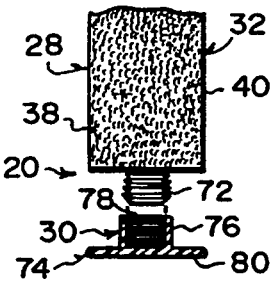
FIG. 5 is an elevational view with parts broken away of a third embodiment of the instant invention.

In FIG. 5, the closure member securing device 30 consists of a plurality of externally ribbed lock grip shanks 72, in which one is shown affixed to an end of one strap 38. A plurality of caps 74 are provided, in which one is shown having a barrel 76 with an internally ribbed lock grip bore 78 and a flange 80 at the closed end of the barrel 76. Each barrel 76 can be inserted into each eyelet 26 of the first set in the shoe 22, with the flange 80 underneath the eyelet 26. Each shank 72 can be pressed into each barrel 76, to be permanently attached thereto.

Figure 7:
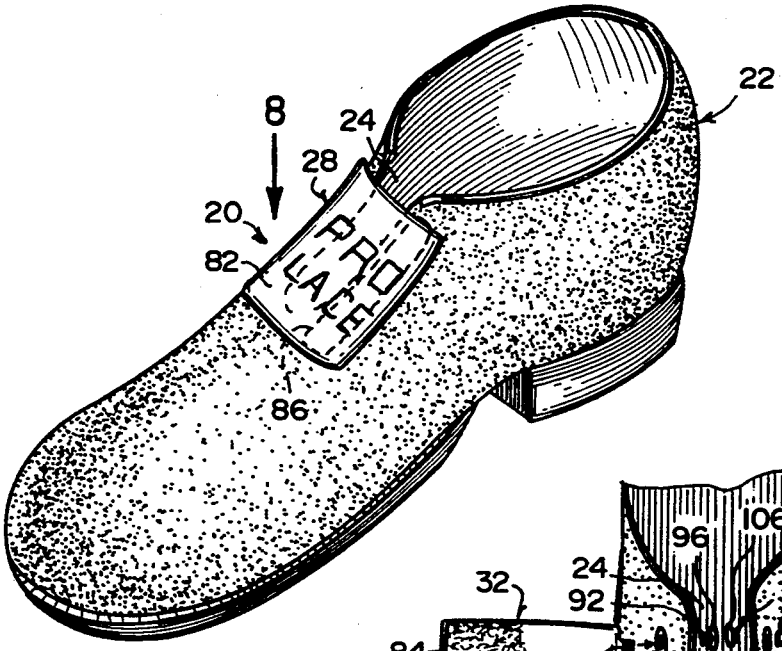
FIG. 7 is a perspective view of a shoe showing a fourth embodiment of the instant invention attached thereto in a closed position.
Figure 8:
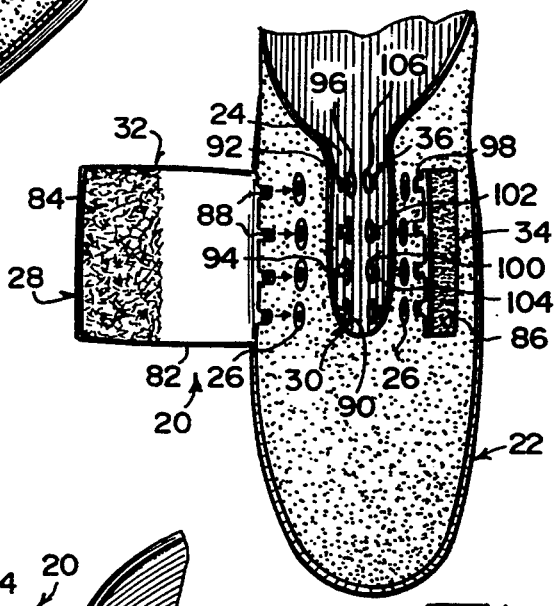
FIG. 8 is a top view taken in the direction of arrow 8 in FIG. 7, with part of the shoe broken away and the fourth embodiment exploded therefrom.
Figure 9:
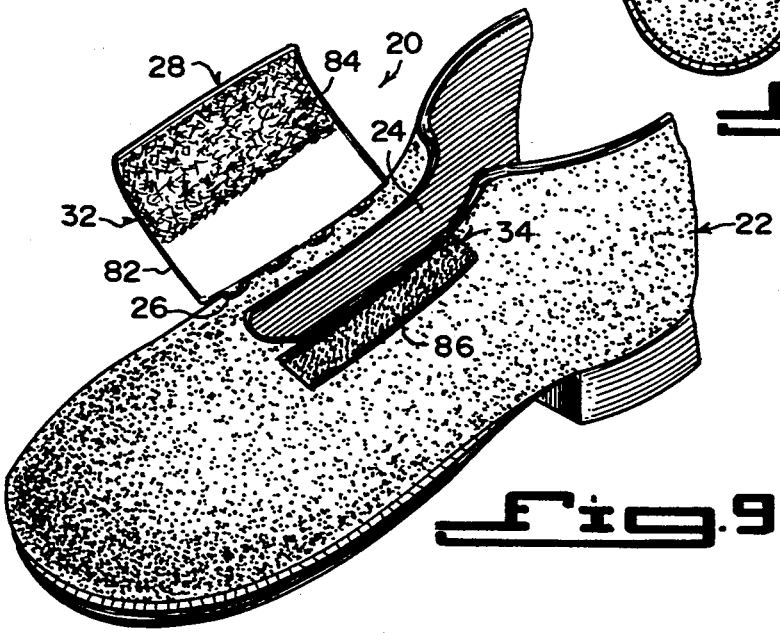
FIG. 9 is a perspective view similar to FIG. 7, with parts of the shoe broken away and the fourth embodiment in an open position.

In FIGS. 7 to 9, the closure member 28 is a broad strap 82. The first portion 32 of the releasing retainer is a hooked VELCRO strip 84 affixed to an underside of the broad strap 82. The second portion 34 of the releasing retainer is a looped VELCRO strip 86, which will engage with the hooked VELCRO strip 84.

The securing apparatus 36 includes a plurality of externally threaded shanks 88, each affixed in a spaced apart relationship to an end of the broad strap 82, so that the shanks 88 can be inserted into the eyelets 26 of the first set in the shoe 22. A plurality of caps 90 are provided, with each having a barrel 92 with an internally threaded bore 94 and a flange 96 at the closed end of the barrel 92. Each barrel 92 can be inserted into each eyelet 26 of the first set in the shoe 22, with the flange underneath the eyelet 26. Each barrel 92 can be screwed onto each shank 88, to be removably attached thereto.

The securing apparatus 36 contains a plurality of externally threaded shanks 98, each affixed in a spaced apart relationship to an underside of the looped VELCRO strip 86. The shanks 98 can be inserted into the eyelet 26 of the second set in the shoe 22. A plurality of caps 100 are provided, with each having a barrel 102 with an internally threaded bore 104 and a flange 106 at the closed end of the barrel 102. Each barrel 102 can be inserted into each eyelet 26 of the second set in the shoe 22, with the flange 106 underneath the eyelet 26. Each barrel 102 can be screwed onto each shank 98 to be removably attached thereto.

Figure 10:
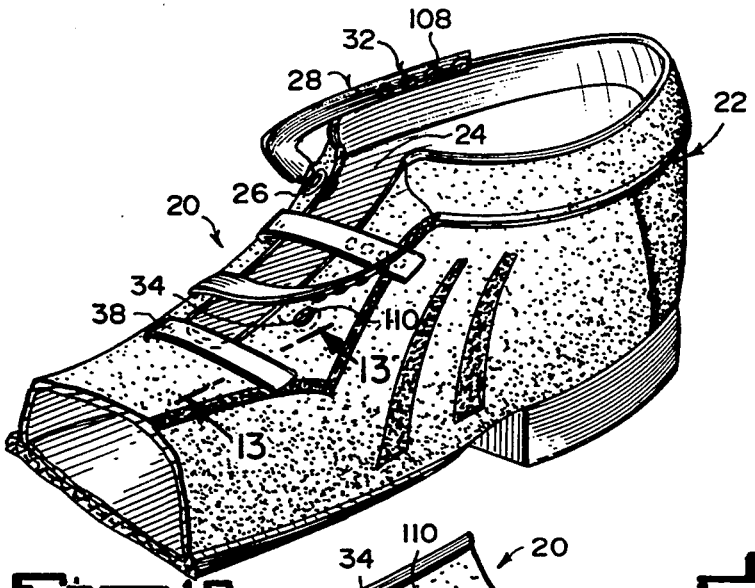
FIG. 10 is a perspective view of a shoe being in a sneaker form with parts broken away, showing a fifth embodiment attached thereto.
Figure 11:
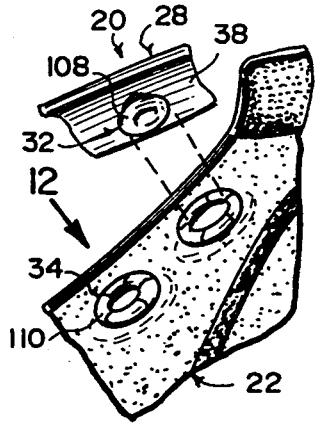
FIG. 11 is an enlarged fragmentary perspective view of the shoe with part of the fifth embodiment in greater detail.
Figure 12:
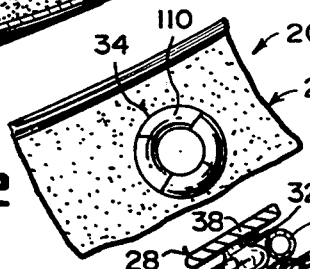
FIG. 12 is a top view taken in the direction of arrow 12 in FIG. 11.
Figure 13:
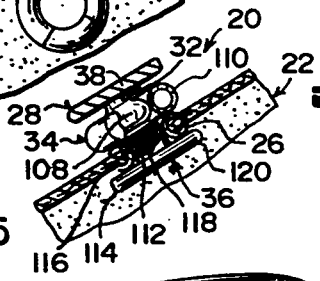
FIG. 13 is an enlarged cross sectional view with parts broken away taken along line 13—13 in FIG. 10.
Figure 13A:
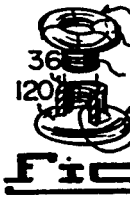
FIG. 13A is an exploded perspective view with parts broken away of the female socket fastener locking cap of the fifth embodiment.

As shown in FIGS. 10, 11 and 13, the first portion 32 of the releasing retainer is a plurality of male snap fasteners 108, some of which are affixed in a spaced apart relationship to an underside of each strap 38. In FIGS. 10 through 13A the second portion 34 of the releasing retainer is a plurality of female socket fasteners 110, in which each will engage with one male snap fastener 108.

The securing apparatus 36 includes a plurality of externally threaded shanks 112, in which each is affixed to an underside of each female socket fastener 110. A plurality of caps 114 are provided, with each having a barrel 116 with an internally threaded bore 118 and a flange 120 at the closed end of the barrel 116. Each barrel 116 can be inserted into each eyelet 26 of the second set in the shoe 22, with the flange 120 underneath the eyelet 26. Each shank 112 can be screwed into each barrel 116, to be removably attached thereto.

Figure 14:
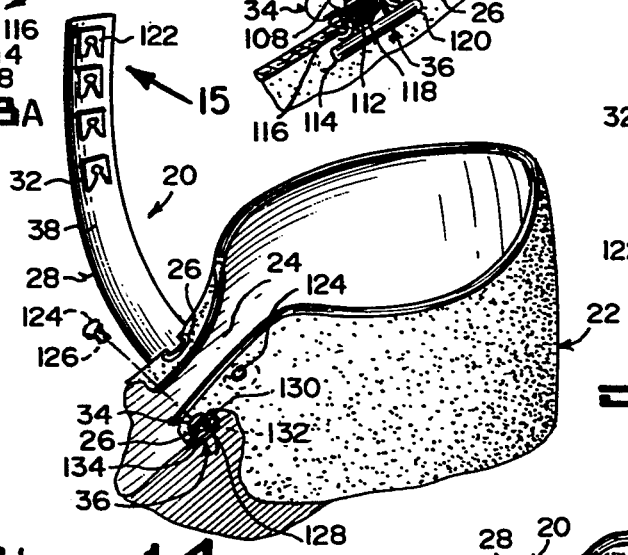
FIG. 14 is a perspective view of a portion of a shoe showing a sixth embodiment attached thereto in an open position.
Figure 15:
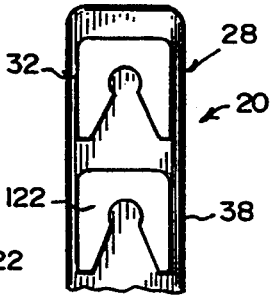
FIG. 15 is an enlarged view taken in the direction of arrow 15 in FIG. 14, showing the hook type fasteners on the underside of the strap in greater detail.
Figure 16:
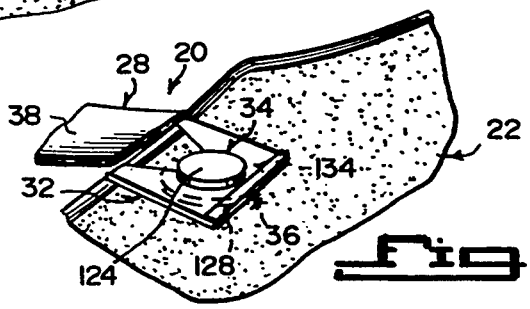
FIG. 16 is an enlarged fragmentary perspective view of the shoe showing part of the sixth embodiment in a closed position.

In FIGS. 14, 15 and 16, the first portion 32 of the releasing retainer is a plurality of hook type fasteners 122, some of which are affixed in a spaced apart relationship to an underside of each strap 38. The second portion 34 of the releasing retainer is a plurality of button heads 124, in which each will engage with one hook type fastener 122.

The securing apparatus 36 contains a plurality of externally threaded shanks 126, each affixed to an underside of each button head 124. A plurality of caps 128 are provided, with each having a barrel 130 with an internally threaded bore 132 and a flange 134 at the closed end of the barrel 130. Each barrel 130 can be inserted into each eyelet 26 of the second set in the shoe 12, with the flange 34 underneath the eyelet 26. Each shank 126 can be screwed into each barrel 130, to be removably attached thereto.

Figure 6:
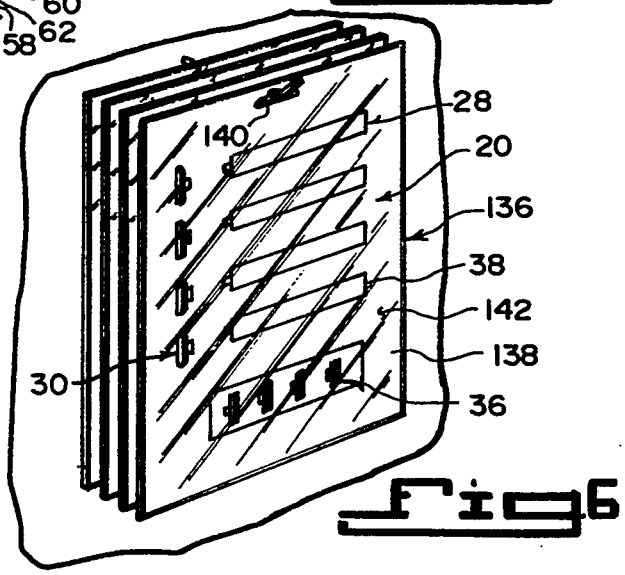
FIG. 6 is a perspective view showing packaged kits for the instant invention.

FIG. 6 shows a packaged kit 136 which consists of a backing panel 138, for mounting the various elements of the fastening conversion system 20 thereto, so as to be displayed therefrom. The backing panel having an aperture 140 located near its top edge, so that it can be hung therefrom. A transparent sheet 142 is retained over the backing panel 138 and the various elements of the fastening conversion system 20 for protection and sealing the kit 136.

LIST OF REFERENCE NUMBERS

20 fastening conversion system
22 shoe
24 throat in 12
26 eyelet in 12
28 closure member
30 closure member securing device
32 first portion of a releasing retainer
34 second portion of a releasing retainer
36 securing apparatus
38 strap for 28
40 hooked VELCRO strip
42 looped VELCRO pad
44 externally threaded shank
46 cap
48 barrel on 46
50 internally threaded bore in 48
52 flange on 48
54 externally threaded shank
56 cap
58 barrel on 56
60 internally threaded bore in 58
62 flange on 58
64 shank
66 flexible dome shaped anchor head
68 shank
70 flexible dome shaped anchor head 72 externally ribbed lock grip shank
74 cap
76 barrel on 74
78 internally ribbed lock grip bore in 76
80 flange on 76
82 broad strap for 28
84 hooked VELCRO strip for 32
86 looped VELCRO strip for 34
88 externally threaded shank
90 cap
92 barrel on 90
94 internally threaded bore in 92
96 flange on 92
98 externally threaded shank
100 cap
102 barrel on 100
104 internally threaded bore in 102
106 flange on 102
108 male snap fastener on 38
110 female socket fastener
112 externally threaded shank
114 cap
116 barrel on 114
118 internally threaded bore in 116
120 flange on 116
122 hook type fastener
124 button head
126 externally threaded shank
128 cap
130 barrel on 128
132 internally threaded bore in 130
134 flange on 130
136 packaged kit
138 backing panel
140 aperture in 138
142 transparent sheet It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A fastening conversion system for a shoe having a throat with a set of spaced apart eyelets on each side of the throat which comprises:
   a) a closure member having a plurality of straps;
   b) means for securing said closure member to the first set of the spaced apart eyelets;
   c) a first portion of a releasing retainer affixed to said closure member;
   d) a second portion of said releasing retainer;
   e) means for securing said second portion of said releasing retainer to a second set of the spaced apart eyelets, so that when said closure member is placed in a closed position over the throat of the shoe, said first portion of said releasing retainer will engage with said second portion of said releasing retainer, to help keep the shoe on a foot of a person wearing the shoe
   f) said first portion of said releasing retainer is a plurality of hooked VELCRO strips, each affixed to underside of each said strap;
   g) said second portion of said releasing retainer is a plurality of looped VELCRO pads in which each will engage with one said hooked VELCRO strip;
   h) wherein said closure member securing means includes a plurality of externally threaded shanks, each affixed to an end of each said strap; and
   i) a plurality of caps, each having a barrel with an internally threaded bore and a flange at the closed end of said barrel, each of said barrel can be inserted into each eyelet of the first set in the shoe, with said flange underneath the eyelet, so that each said shank can be screwed into each said barrel, to be removably attached thereto.

2. A fastening conversion system as recited in claim 1, wherein said second portion of said releasing retainer securing means includes:
   a) a plurality of externally threaded shanks, each affixed to an underside of each said looped VELCRO pad; and
   b) a plurality of caps, each having a barrel with an internally threaded bore and a flange at the closed end of said barrel, each said barrel can be inserted into each eyelet of the second set in the shoe with said flange underneath the eyelet, so that each said shank can be screwed into each said barrel, to be removably attached thereto.

3. A fastening conversion system as recited in claim 1, wherein said closure member securing means includes:
   a) a plurality of externally ribbed lock grip shanks, each affixed to an end of each said strap; and
   b) a plurality of caps, each having a barrel with an internally ribbed lock grip bore and a flange at the closed end of said barrel, each said barrel can be inserted into each eyelet of the first set in the shoe with said flange underneath the eyelet, so that each said shank can be pressed into each said barrel, to be permanently attached thereto.

4. A fastening conversion system as recited in claim 1, wherein said closure member is a broad strap.

5. A fastening conversion system as recited in claim 4, wherein said first portion of said releasing retainer is a hooked VELCRO strip affixed to an underside of said board strap.

6. A fastening conversion system as recited in claim 5, wherein said second portion of said releasing retainer is a looped VELCRO strip, which will engage with said hooked VELCRO strip.

7. A fastening conversion system as recited in claim 6, wherein said closure member securing means includes:
   a) a plurality of externally threaded shanks, each affixed in a spaced apart relationship to an end of said broad strap, so that said shanks can be inserted into the eyelets of the first set in the shoe; and
   b) a plurality of caps, each having a barrel with an internally threaded bore and a flange at the closed end of said barrel, each said barrel can be inserted into each eyelet of the first set in the shoe with said flange underneath the eyelet, so that each said barrel can be screwed onto each said shank, to be removably attached thereto.

8. A fastening conversion system as recited in claim 7, wherein said second portion of said releasing retainer securing means includes:

a) a plurality of externally threaded shanks, each affixed in a spaced apart relationship to an underside of said looped VELCRO strip, so that said shanks can be inserted into the eyelets of the second set in the shoe; and b) a plurality of caps, each having a barrel with an internally threaded bore and a flange at the closed end of said barrel, each said barrel can be inserted into each eyelet of the second set in the shoe with said flange underneath the eyelet, so that each said barrel can be screwed onto each said shank, to be removably attached thereto.

9. A fastening conversion system as recited in claim 1, wherein said first portion of said releasing retainer is a plurality of male snap fasteners, some of which are affixed in a spaced apart relationship to an underside of each said strap.

10. A fastening conversion system as recited in claim 9, wherein said second portion of said releasing retainer is a plurality of female socket fasteners, in which each will engage with one said male snap fastener.

11. A fastening conversion system as recited in claim 10, wherein said second portion of said releasing retainer securing means includes:

a) a plurality of externally threaded shanks, each affixed to an underside of each said female socket fastener; and b) a plurality of caps, each having a barrel with an internally threaded bore and a flange at the closed end of said barrel, each said barrel can be inserted into each eyelet of the second set in the shoe with said flange underneath the eyelet, so that each said shank can be screwed into each said barrel, to be removably attached thereto.

12. A fastening conversion system as recited in claim 1, wherein said first portion of said releasing retainer is a plurality of hook type fasteners, some of which are affixed in a spaced apart relationship to an underside of each said strap.

13. A fastening conversion system as recited in claim 12 wherein said second portion of said releasing retainer is a plurality of button heads, in which each will engage with one said hook type fastener.

14. A fastening conversion system as recited in claim 13, wherein said second portion of said releasing retainer securing means includes:

a) a plurality of externally threaded shanks, each affixed to an underside of each said button head; and b) a plurality of caps, each having a barrel with an internally threaded bore and a flange at the closed end of said barrel, each said barrel can be inserted into each eyelet of the second set in the shoe with said flange underneath the eyelet, so that each said shank can be screwed into each said barrel, to be removably attached thereto.

15. A fastening conversion system s recited in claim 1, further including a packaged kit which includes:

a) a backing panel for mounting the various elements of said fastening conversion system thereto, so as to be displayed therefrom, said backing panel having an aperture located near its top edge, so that it can be hung therefrom; and b) a transparent sheet retained over said backing panel and the various elements of said fastening conversion system for protection and sealing said kit.

* * * * *